US006725939B2

(12) United States Patent
Richard

(10) Patent No.: US 6,725,939 B2
(45) Date of Patent: Apr. 27, 2004

(54) EXPANDABLE CENTRALIZER FOR DOWNHOLE TUBULARS

(75) Inventor: Bennett M. Richard, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/174,106

(22) Filed: Jun. 18, 2002

(65) Prior Publication Data

US 2003/0230411 A1 Dec. 18, 2003

(51) Int. Cl.[7] ..... E21B 17/10
(52) U.S. Cl. ..... 166/384; 166/241.6
(58) Field of Search ..... 166/207, 384, 166/241.6

(56) References Cited

U.S. PATENT DOCUMENTS

| | | | | |
|---|---|---|---|---|
| 2,611,664 A | | 9/1952 | Kothny | |
| 2,812,025 A | * | 11/1957 | Teague et al. | 166/207 |
| 2,931,440 A | | 4/1960 | Lebourg | |
| 3,528,499 A | | 9/1970 | Collett | |
| 3,578,084 A | * | 5/1971 | Bombardieri et al. | 166/241.6 |
| 4,088,185 A | | 5/1978 | Carson | |
| 4,483,395 A | | 11/1984 | Kramer et al. | |
| 4,693,328 A | | 9/1987 | Furse et al. | |
| 5,566,754 A | | 10/1996 | Stokka | |
| 5,785,125 A | | 7/1998 | Royer | |
| 5,908,072 A | | 6/1999 | Hawkins | |
| 6,095,242 A | * | 8/2000 | Lequang et al. | 166/88.2 |
| 6,102,118 A | | 8/2000 | Moore | |
| 6,112,813 A | | 9/2000 | Head | |
| 6,112,818 A | * | 9/2000 | Campbell | 166/207 |
| 6,283,205 B1 | | 9/2001 | Cannon | |
| 6,315,497 B1 | * | 11/2001 | Wittman et al. | 166/248 |
| 6,367,556 B1 | * | 4/2002 | Moore | 166/241.1 |
| 6,435,275 B1 | * | 8/2002 | Kirk et al. | 166/241.1 |
| 6,457,519 B1 | | 10/2002 | Buytaert | |
| 6,513,223 B1 | | 2/2003 | Angman et al. | |
| 6,564,870 B1 | | 5/2003 | Grigsby et al. | |
| 2003/0106719 A1 | * | 6/2003 | Herrera | 166/241.6 |
| 2003/0150611 A1 | * | 8/2003 | Buytaert | 166/241.6 |
| 2003/0164236 A1 | * | 9/2003 | Thornton | 166/241.6 |

FOREIGN PATENT DOCUMENTS

WO WO 02/10550 A1 2/2002

* cited by examiner

*Primary Examiner*—David Bagnell
*Assistant Examiner*—Matthew J Smith
(74) *Attorney, Agent, or Firm*—Steve Rosenblatt

(57) ABSTRACT

Centralizers made of a non-metallic material in a variety of styles are placed on the exterior of tubing or casing prior to expansion. The compliant nature of such materials, when put into service in a centralizer for tubulars to be expanded prevents scoring the pipe on the way downhole. Scratches or scores of the pipe can be the location of stress fractures on expansion. Additionally, the resilient nature of the centralizers prevents them from adding significantly to the required expansion force and allows them to act as seals against channeling in the cemented annular space after expansion.

9 Claims, 2 Drawing Sheets

EXPANDABLE CENTRALIZER FOR DOWNHOLE TUBULARS

FIELD OF THE INVENTION

The field of the invention is centralizers that are used in conjunction with tubulars that are to be expanded downhole.

BACKGROUND OF THE INVENTION

Centralizers have been in use for a long time. As their name suggests they have been used to center a tubular in a borehole. Most commonly, centralizers are used to position casing in the borehole as the cement is delivered into the annular space around the outside of the casing to set up and seal the casing in the bore hole. Centralizers have also been used as guides for sucker rods in downhole pumps. The centralizers have been made of metal and non-metallic materials such as thermoplastic polyamides, glass and mineral filled nylons and poly-tetra fluoro ethylene, also known as Teflon and injection molded polyurethane. These centralizers were made in hinged segments that could be clamped onto a tubular and in some applications the centralizers were formed right on to or slipped over the rod or tubular. Illustrative examples of the variations in prior centralizers are shown in U.S. Pat. Nos. 4,483,395; 4,088,185; 3,963,075; 2,611,664; 5,908,072; 6,102,118; and 6,283,205.

More recently, tubulars such as casing have been expanded downhole after cementing and sometimes without cementing. The centralizers used on casing for expansion have been metallic and have caused problems. Recently, one such problem has been reported in the March 2002 issue of Drilling Magazine on page 36. There a tempered steel arm of a centralizer had broken off and damaged the pipe to be expanded. The problem is that if the pipe to be expanded is scored prior to expansion, the stress is concentrated at that area and a fracture is likely upon expansion. There has been some recognition of this concern in the way the expandable tubulars are handled on the surface. Expandable tubulars are picked up with forklifts that have padded forks. The joints are packaged with wooden dividers to avoid contact with each other. Nylon slings are used to pick up joints one at a time onto the rig. Non-penetrating tongs are used to get a friction grip on the connections during makeup. Despite all these surface handling precautions, metallic centralizers have continued to be used. These centralizers are sufficiently rigid to increase the force required on the swage for expansion downhole. At times, the swage has stalled as the stroker has tried to advance it in the location of a relatively unyielding centralizer. Occasionally, the metallic centralizers used on casing to be expanded have had flexible strips break during run in and have scored the outer surface of the casing to the point that when the casing was expanded the stress concentration at the point of scoring initiated a fracture failure during expansion.

The object of the present invention is to provide centralizers for tubulars that are to be expanded that are compatible with downhole environmental conditions and are flexible enough so as to avoid significantly increasing the force required to expand the pipe and centralizers combination. Additionally, the centralizers are preferably non-metallic to avoid scoring the pipe during run in or if a piece of the centralizer should break leaving an exposed end. The soft nature of the preferred centralizer, allows it to act as a seal for the cement at one or both ends, as the expansion pressure reforms the ring shaped ends of the centralizer to assume the shape of the borehole wall to minimize channeling along the outside of the tubular even though there has been cement placed in the annulus around the tubular. These and other advantages of the present invention will be more readily apparent to those skilled in the art from a review of the description of the preferred embodiment and the claims below.

SUMMARY OF THE INVENTION

Centralizers made of a non-metallic material in a variety of styles are placed on the exterior of tubing or casing prior to expansion. The compliant nature of such materials, when put into service in a centralizer for tubulars to be expanded prevents scoring the pipe on the way downhole. Scratches or scores of the pipe can be the location of stress fractures on expansion. Additionally, the resilient nature of the centralizers prevents them from adding considerably to the required expansion force and allows them to act as seals against channeling in the cemented annular space after expansion.

DETAILED DESCRIPTION OF THE PREFERRED EMBODIMENT

Figure 1:
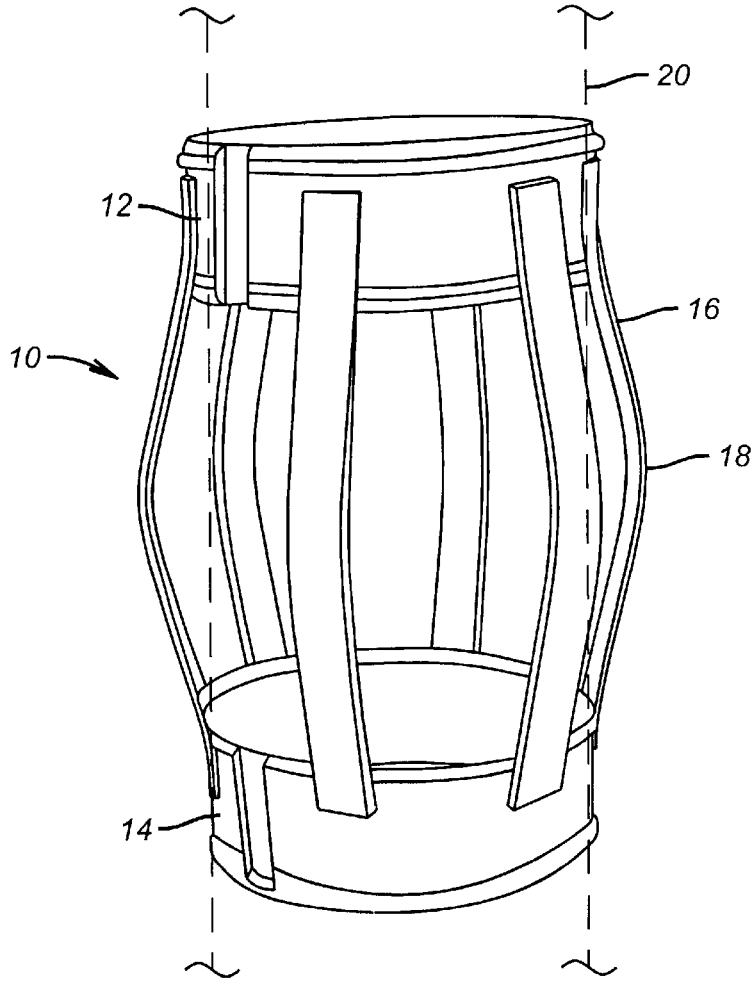
FIG. 1 is an elevation view of one style of a non-metallic centralizer for use with a tubular to be expanded.
Figure 2:
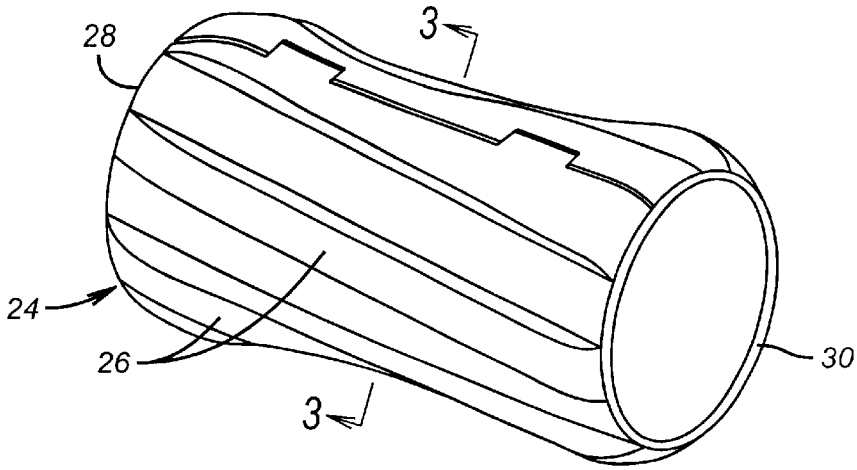
FIG. 2 is another type of centralizer having ribs for use with tubulars to be expanded.
Figure 3:
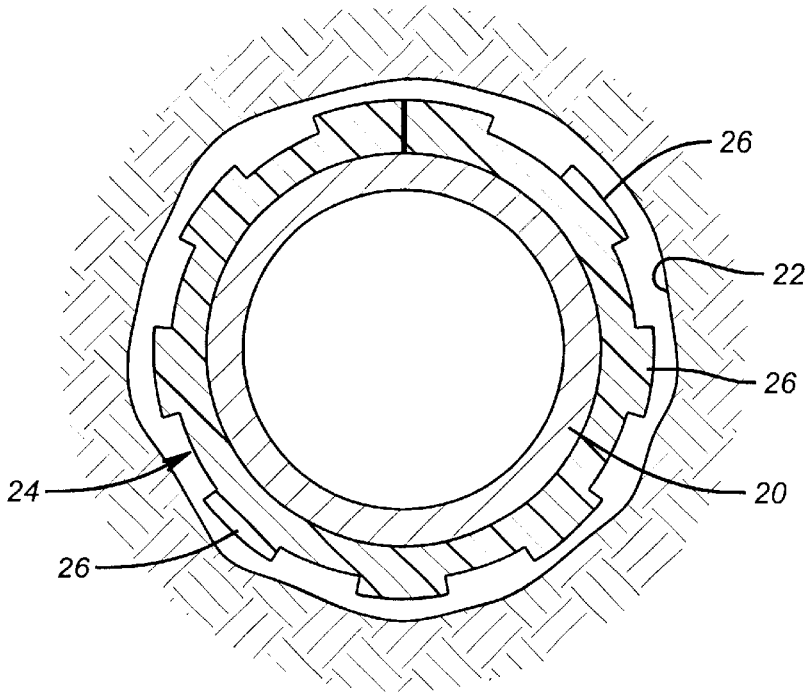
FIG. 3 is the view along lines 3—3 of FIG. 2 prior to expansion.
Figure 4:
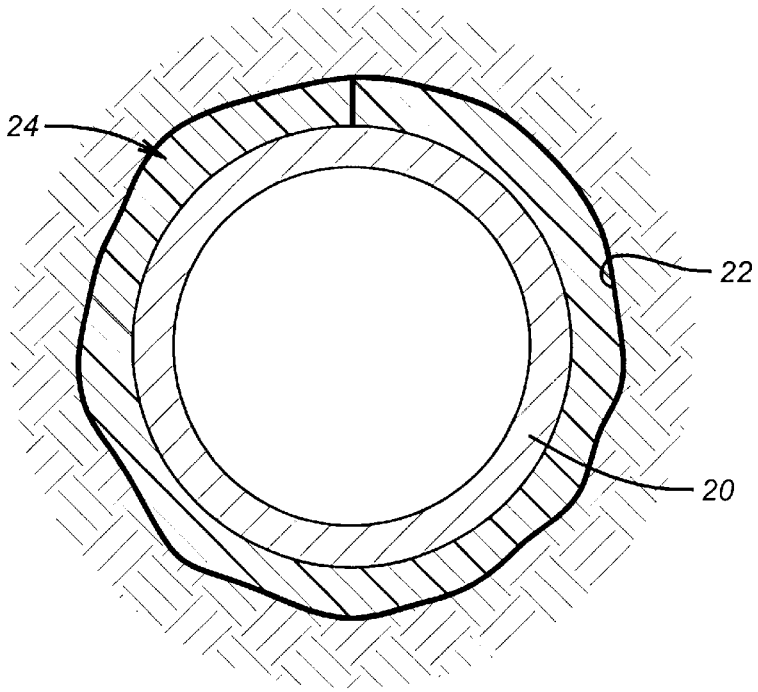
FIG. 4 is the view of FIG. 3 after expansion showing how an end seals the annular space around the tubular.

FIG. 1 illustrates a centralizer 10 having a pair of end rings 12 and 14, which are connected by flexible strips 16 which are bowed out at 18. The centralizer 10 can be hinged and clasped to allow it to be opened and mounted on the tubular 20 and clasped shut. The material is non-metallic. For applications below about 230 degrees Fahrenheit, the material of choice for the entire centralizer 10 is high-density polyethylene. For higher temperatures, composite materials or thermoplastics can be used. The material selection criteria for the centralizer include tolerance to the downhole conditions of temperature and chemical compatibility. Furthermore, the material must be relatively resilient so that on running in there is little risk that the centralizer 10 will score the outer surface of the tubular 20 if the centralizer 10 is pushed through a tight spot. For example, if any of the strips 16 snap on the way downhole, there is little risk of scoring the outer surface of the tubular using a non-metallic material for the centralizer 10. The end rings 12 and 14 are reshaped during expansion of the tubular 20 to take the shape of the borehole 22, as shown in FIG. 4. In this manner the end rings 12 and 14 act as seals to minimize or eliminate fluid channeling in the annular space outside the tubular 20.

The centralizer 24 is a slightly different design having rigid ribs 26 spaced out by end rings 28 and 30. The material is as before preferably a resilient material that is non-metallic and is compatible with the conditions downhole. This design does not add to the required force to drive the swage for expansion, minimizes the possibility of scoring the pipe during run in or expansion and provides one or two seals at its upper or lower ends against channeling in the annulus outside the tubular 20. The method of the present invention contemplates the use of centralizers for tubulars to be expanded wherein any design of centralizer can be used as long as it is made of a material that will minimize the chance of scoring the pipe. Scoring the pipe can lead to stress concentration and a source for a fracture during expansion. Ideally, the centralizer will yield to the expansion force from a swage so that the required force will not be significantly increased on the swage. In this manner, the swage will be less likely to stall as it reaches a centralizer. Finally, the centralizer, after expansion, due to its resiliency and the size of the expansion force, will take the shape of the borehole for a seal against channeling.

The foregoing disclosure and description of the invention are illustrative and explanatory thereof, and various changes in the size, shape and materials, as well as in the details of the illustrated construction, may be made without departing from the spirit of the invention.

I claim:

1. A method of expanding a tubular downhole, comprising:

mounting at least one non-metallic centralizer on the tubular;

running the tubular and said centralizer downhole;

reducing the possibility of scoring the tubular when running downhole by using said non-metallic centralizer; and expanding the tubular.

2. A method of expanding a tubular downhole, comprising:

mounting at least one non-metallic centralizer on the tubular;

running the tubular and said centralizer downhole;

expanding the tubular; and selecting a material for said centralizer to be sufficiently resilient to avoid scoring the tubular during run in or expansion.

3. The method of claim 2, further comprising:

reshaping said centralizer due to said expansion.

4. The method of claim 3, further comprising:

creating at least one seal with said centralizer against channeling in the annular space around the expanded tubular.

5. The method of claim 2, further comprising:

avoiding scoring of the tubular from any broken component of said centralizer that breaks on run in or during expansion.

6. A method of expanding a tubular downhole, comprising:

mounting at least one non-metallic centralizer on the tubular;

running the tubular and said centralizer downhole; and expanding the tubular;

selecting a material for said centralizer to be sufficiently resilient to avoid scoring the tubular during run in or expansion;

reshaping said centralizer due to said expansion;

creating at least one seal with said centralizer against channeling in the annular space around the expanded tubular;

providing at least one end ring on said centralizer;

using said end ring to create said seal.

7. The method of claim 6, further comprising:

using a composite material for the centralizer.

8. The method of claim 7, further comprising:

using high-density polyethylene for said centralizer.

9. A method of expanding a tubular downhole, comprising:

mounting at least one non-metallic centralizer on the tubular;

running the tubular and said centralizer downhole;

reducing the possibility of scoring the tubular when running downhole by using said non-metallic centralizer;

expanding the tubular;

providing at least one end ring on said centralizer;

using said end ring to create a seal around the tubular.

* * * * *